US008558469B2

(12) United States Patent
Huang et al.

(10) Patent No.: US 8,558,469 B2
(45) **Date of Patent: *Oct. 15, 2013**

(54) APPARATUS AND METHOD FOR DRIVING FLUORESCENT LAMP

(75) Inventors: Shih-Chung Huang, Taipei (TW); Kuang-Yu Jung, Taipei (TW)

(73) Assignee: Beyond Innovation Technology Co., Ltd., Taipei (TW)

( * ) Notice: Subject to any disclaimer, the term of this patent is extended or adjusted under 35 U.S.C. 154(b) by 206 days.

This patent is subject to a terminal disclaimer.

(21) Appl. No.: 13/107,948

(22) Filed: May 15, 2011

(65) Prior Publication Data

US 2012/0081020 A1 Apr. 5, 2012

(30) Foreign Application Priority Data

Sep. 30, 2010 (TW) ..... 99133376 A

(51) Int. Cl.
*H05B 37/02* (2006.01)
*H05B 41/16* (2006.01)

(52) U.S. Cl.
USPC ..... 315/209 R; 315/246

(58) Field of Classification Search
None
See application file for complete search history.

(56) References Cited

U.S. PATENT DOCUMENTS

2005/0067972 A1* 3/2005 Lee et al. ..... 315/200 R
2007/0159107 A1* 7/2007 Powell ..... 315/149
2009/0267669 A1* 10/2009 Kasai ..... 327/164

* cited by examiner

*Primary Examiner* — Crystal L Hammond
(74) *Attorney, Agent, or Firm* — Jianq Chyun IP Office

(57) ABSTRACT

An apparatus and a method for driving a fluorescent lamp are provided. The apparatus submitted by the present invention includes a power switching circuit, an LC resonator and an automatic frequency tracing circuit. The power switching circuit is coupled between an input voltage and a ground potential, and is used for switching and outputting the input voltage and the ground potential in response to a ramp signal and a comparison voltage so as to generate a square signal. The LC resonator is used for receiving and converting the square signal to generate a sinusoidal driving signal for driving the fluorescent lamp. The automatic frequency tracing circuit is used for generating and adjusting the ramp signal according to a feedback signal related to the sinusoidal driving signal, so as to make a frequency of the sinusoidal driving signal automatically following a resonant frequency of the LC resonator.

15 Claims, 9 Drawing Sheets

APPARATUS AND METHOD FOR DRIVING FLUORESCENT LAMP

CROSS-REFERENCE TO RELATED APPLICATION

This application claims the priority benefit of Taiwan application serial no. 99133376, filed Sep. 30, 2010. The entirety of the above-mentioned patent application is hereby incorporated by reference herein and made a part of this specification.

BACKGROUND

1. Field of the Invention

The invention relates to a driving technique of a fluorescent lamp. Particularly, the invention relates to an apparatus and a method for driving a fluorescent lamp without using a boost transformer.

2. Description of Related Art

Fluorescent lamps (for example, cold cathode fluorescent lamps (CCFLs)) are widely applied to the backlight systems in monitors and televisions of large-scale liquid crystal displays (LCDs). As shown in FIG. 1, an apparatus 10 used for driving a CCFL CL generally includes a power switching circuit 101, a boost transformer T, and a resonator formed by a leakage inductance of the boost transformer T and two capacitors C.

Generally, the power switching circuit 101 is coupled between an input voltage $V_{DD}$ (which is a direct current (DC) voltage of about 380V) and a ground potential GND, and is used for switching and outputting the input voltage $V_{DD}$ and the ground potential GND in response to a ramp signal RMP with fixed frequency and a comparison voltage CMP, so as to generate a square signal SQ. Moreover, the resonator formed by the leakage inductance of the boost transformer T and the two capacitors C filters/converts the square signal SQ generated by the power switching circuit 101 to generate a sinusoidal driving signal SIN (which has a root mean square (RMS) value of about 342V) for driving the CCFL CL.

However, since the CCFL CL requires a relative high operation voltage with an RMS value of about 700V, the boost transformer T has to be used to boost the sinusoidal driving signal SIN to a voltage range capable of operating the CCFL CL. Therefore, the apparatus 10 used for driving the CCFL CL has to use the boost transformer T, or otherwise the CCFL CL cannot be successfully driven.

SUMMARY OF THE INVENTION

Accordingly, the invention is directed to an apparatus and a method for driving a fluorescent lamp without using a boost transformer.

The invention provides an apparatus for driving a fluorescent lamp, which includes a power switching circuit, an LC resonator and an automatic frequency tracing circuit. The power switching circuit is coupled between an input voltage and a ground potential, and is used for switching and outputting the input voltage and the ground potential in response to a ramp signal and a comparison voltage so as to generate a square signal. The LC resonator is coupled to the power switching circuit, and is used for receiving and converting the square signal so as to generate a sinusoidal driving signal for driving the fluorescent lamp. The automatic frequency tracing circuit is coupled to the power switching circuit and the LC resonator, and is used for generating and adjusting the ramp signal according to a feedback signal related to the sinusoidal driving signal, so as to make a frequency of the sinusoidal driving signal automatically following a resonant frequency of the LC resonator.

In an embodiment of the invention, the power switching circuit includes a first comparator, a phase-splitting circuit, a buffering circuit and a switching circuit. A negative input terminal of the first comparator is used for receiving the ramp signal, a positive input terminal of the first comparator is used for receiving the comparison voltage, and an output terminal of the first comparator is used for outputting a first pulse width modulation (PWM) signal. The phase-splitting circuit is coupled to the first comparator, and is used for receiving the first PWM signal and performing phase-splitting to the first PWM signal in response to a comparison signal, or directly performing the phase-splitting to the first PWM signal to obtain two output signals with a phase difference of 180 degrees. The buffering circuit is coupled to the phase-splitting circuit, and is used for receiving and buffering-outputting the two output signals. The switching circuit is coupled between the input voltage and the ground potential and is coupled to the buffering circuit. The switching circuit is used for switching and outputting the input voltage and the ground potential in response to the two buffered output signals, so as to generate the square signal.

In an embodiment of the invention, the LC resonator includes a first to a third capacitors and an inductor. A first end of the first capacitor receives the square signal. A first end of the inductor is coupled to a second end of the first capacitor, and a second end of the inductor is used for generating the sinusoidal driving signal. A first end of the second capacitor is coupled to the second end of the inductor, and a second end of the second capacitor is used for generating the feedback signal. A first end of the third capacitor is coupled to the second end of the second capacitor, and a second end of the third capacitor is coupled to the ground potential.

In an embodiment of the invention, the automatic frequency tracing circuit includes a phase-shifting circuit, a pulse signal generator and a ramp generator. The phase-shifting circuit is used for receiving the feedback signal, and shifting a current phase of the feedback signal to output a phase-shifting signal. The pulse signal generator is coupled to the phase-shifting circuit and the phase-splitting circuit, and is used for generating a pulse signal in response to the phase-shifting signal and providing the comparison signal. The ramp generator is coupled to the pulse signal generator and the first comparator, and is used for generating the ramp signal in response to the pulse signal.

In an embodiment of the invention, the automatic frequency tracing circuit further includes a starting of oscillation circuit, which is coupled to the ramp generator, and is used for generating a starting of oscillation pulse signal to the ramp generator in response to an enable signal when the ramp generator does not obtain the pulse signal, so as to make the ramp generator generating the ramp signal until the ramp generator obtains the pulse signal.

In an embodiment of the invention, the automatic frequency tracing circuit further includes a detection circuit, which is coupled to the starting of oscillation circuit, and is used for detecting the phase-shifting signal and generating the enable signal to the starting of oscillation circuit when the phase-shifting signal is not oscillated.

In an embodiment of the invention, the apparatus for driving the fluorescent lamp further includes a current regulation circuit, which is coupled to the fluorescent lamp and the power switching circuit, and is used for generating the comparison voltage in response to a current flowing through the fluorescent lamp and a predetermined reference voltage, so as to adjust the first PWM signal output by the first comparator, and stabilize the current flowing through the fluorescent lamp to a predetermined current value.

In an embodiment of the invention, the apparatus for driving the fluorescent lamp further includes a protection circuit, which is coupled to the LC resonator and the phase-splitting circuit, and is used for receiving the feedback voltage and generating an over voltage protection signal to disable the phase-splitting circuit when the feedback voltage is greater than a first predetermined reference voltage. Moreover, the protection circuit is further coupled to the fluorescent lamp and the current regulation circuit, and is further used for determining whether or not to generate an over current protection signal to disable the phase-splitting circuit according to a transformation voltage related to the current flowing through the fluorescent lamp. When the transformation voltage is greater than a second predetermined reference voltage, the protection circuit generates the over current protection signal to disable the phase-splitting circuit.

In an embodiment of the invention, the apparatus for driving the fluorescent lamp further includes a clamp circuit, which is coupled to the LC resonator, and is used for generating a clamp voltage in response to the feedback signal and a predetermined reference voltage, so as to suppress a voltage of the sinusoidal driving signal to a predetermined voltage value. In this case, the power switching circuit may further include a second comparator and an AND gate. A positive input terminal of the second comparator receives the clamp voltage, a negative input terminal of the second comparator is coupled to the negative input terminal of the first comparator, and an output terminal of the second comparator outputs a second PWM signal. A first input terminal of the AND gate is coupled to the output terminal of the first comparator, a second input terminal of the AND gate is coupled to the output terminal of the second comparator, and an output terminal of the AND gate outputs a third PWM signal to the phase-splitting circuit.

The invention also provides a method for driving a fluorescent lamp. The method includes switching an input voltage and a ground potential in response to a ramp signal and a comparison voltage under a pulse width modulation (PWM) structure, so as to generate a square signal; using an LC resonance manner/means to convert the square signal, so as to generate a sinusoidal driving signal for driving the fluorescent lamp; and generating and adjusting the ramp signal according to a feedback signal related to the sinusoidal driving signal, so as to make a frequency of the sinusoidal driving signal automatically following a resonant frequency corresponding to the LC resonance manner/means.

From the above, in the invention, the automatic frequency tracing circuit is used to trace the resonant frequency of the LC resonator, so that regardless of how the resonant frequency of the LC resonator varies, the automatic frequency tracing circuit makes the frequency of the sinusoidal driving signal that is generated by the LC resonator and used for driving the fluorescent lamp to automatically follow the resonant frequency of the LC resonator. In this way, as long as a quality factor (Q value) of the LC resonator is designed relatively higher, a relatively large output to input ratio is obtained, so that the fluorescent lamp can be successfully driven without using a boost transformer.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
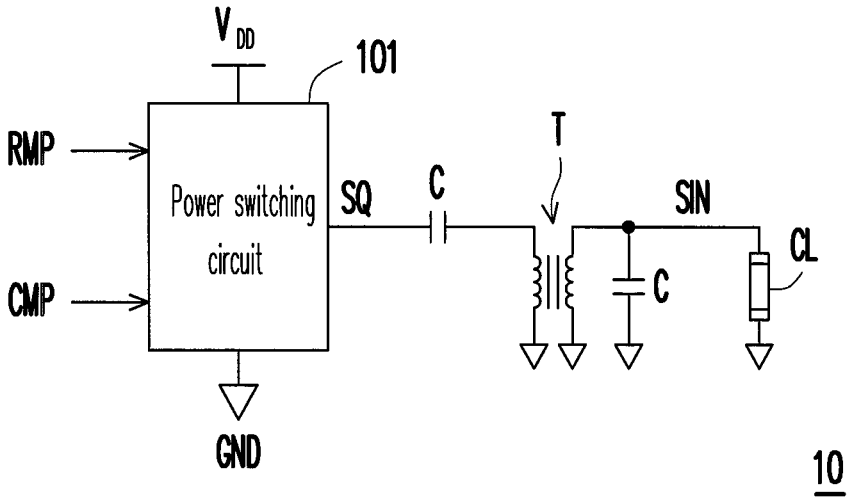
FIG. 1 (RELATED ART)
FIG. 1 is a schematic diagram of a conventional driving apparatus 10 of a fluorescent lamp CL.

Reference will now be made in detail to the present preferred embodiments of the invention, examples of which are illustrated in the accompanying drawings. Wherever possible, the same reference numbers are used in the drawings and the description to refer to the same or like parts.

Figure 2:
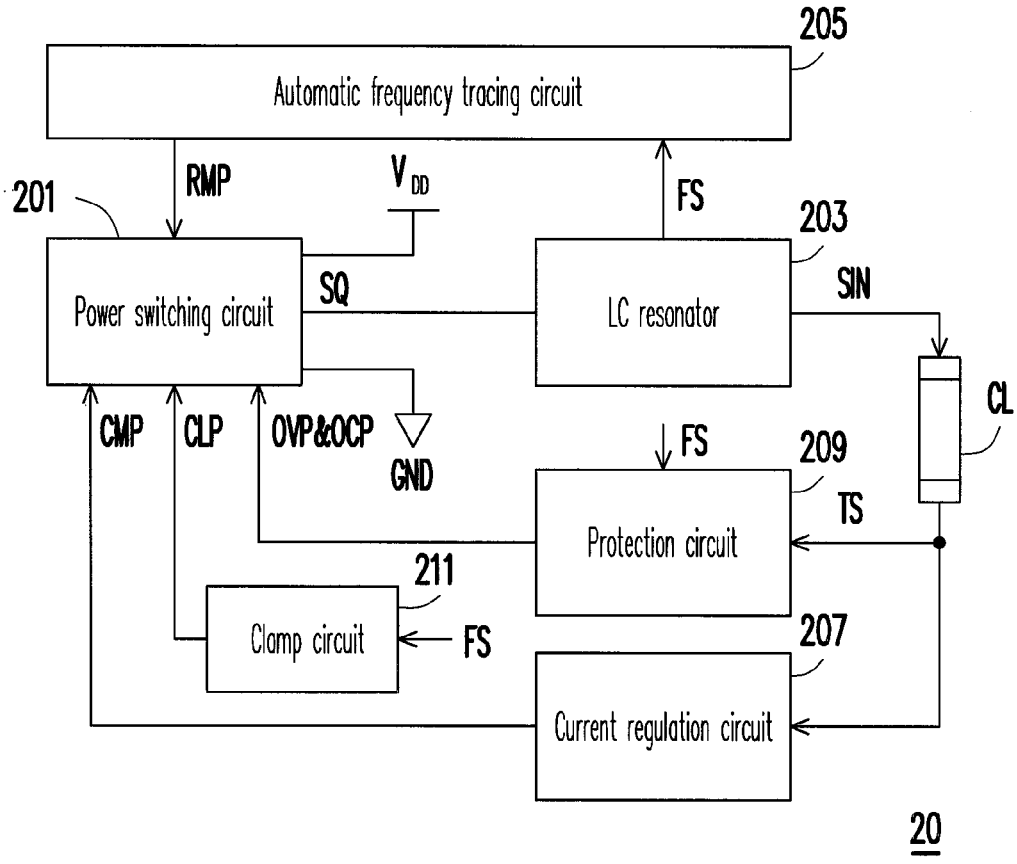
FIG. 2 is a schematic diagram of a driving apparatus 20 of a fluorescent lamp CL according to an embodiment of the invention.
Figure 3:
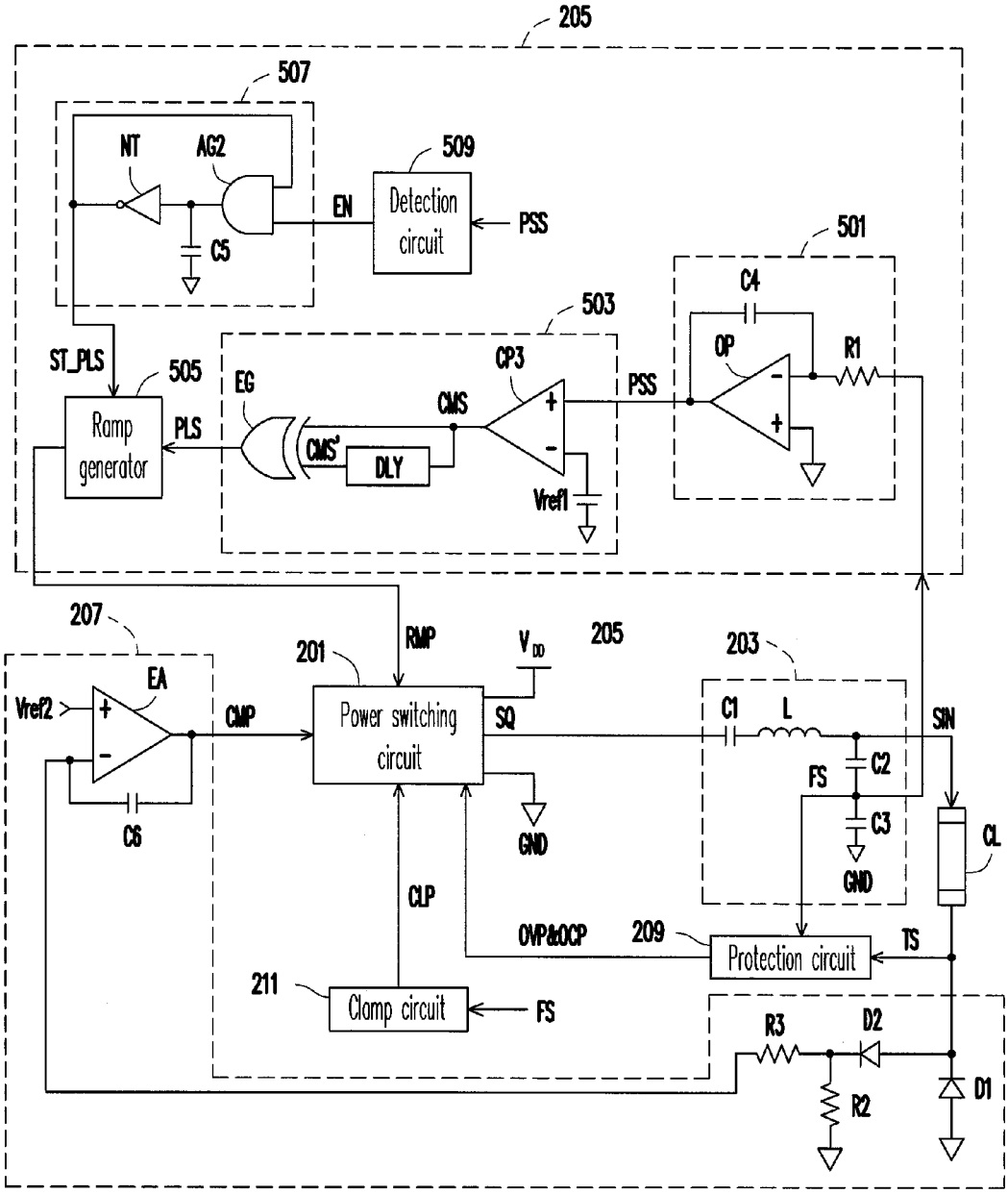
FIG. 3 is a circuit schematic diagram of the driving apparatus 20 of FIG. 2.

FIG. 2 is a schematic diagram of a driving apparatus 20 of a fluorescent lamp CL according to an embodiment of the invention, and FIG. 3 is a circuit schematic diagram of the driving apparatus 20. Referring to FIG. 2 and FIG. 3, the driving apparatus 20 of the present embodiment is at least adapted to drive a cold cathode fluorescent lamp (CCFL, though the invention is not limited thereto, and other types of the fluorescent lamp can also be applied), and the driving apparatus 20 includes a power switching circuit 201, an LC resonator 203, an automatic frequency tracing circuit 205, a current regulation circuit 207, a protection circuit 209 and a clamp circuit 211. The power switching circuit 201 is coupled between an input voltage $V_{DD}$ (which is a direct current (DC) voltage of about 380V) and a ground potential GND, and is used for switching and outputting the input voltage $V_{DD}$ and the ground potential GND in response to a ramp signal RMP generated by the automatic frequency tracing circuit 205 and a comparison voltage CMP generated by the current regulation circuit 207, so as to generate a square signal SQ.

Figure 4:
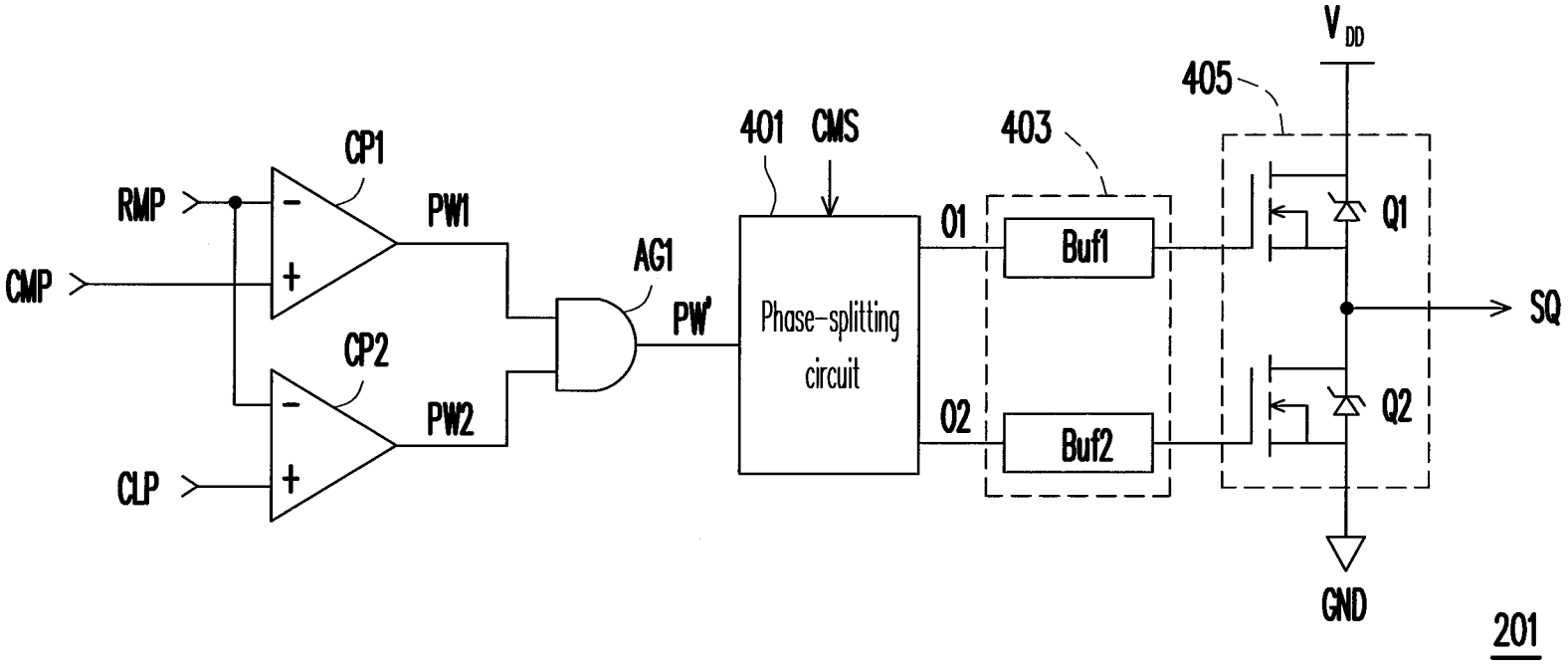
FIG. 4 is a schematic diagram of a power switching circuit 201 according to an embodiment of the invention.

In detail, FIG. 4 is a schematic diagram of the power switching circuit 201 according to an embodiment of the invention. Referring to FIG. 2 to FIG. 4, the power switching circuit 201 includes comparators CP1 and CP2, an AND gate AG1, a phase-splitting circuit 401, a buffering circuit 403 and a switching circuit 405. A negative input terminal (−) of the comparator CP1 receives the ramp signal RMP, a positive input terminal (+) of the comparator CP1 receives the comparison voltage CMP, and an output terminal of the comparator CP1 outputs a pulse width modulation (PWM) signal PW1.

A positive input terminal (+) of the comparator CP2 receives a clamp voltage CLP generated by the clamp circuit 211, a negative input terminal (−) of the comparator CP2 is coupled to the negative input terminal (−) of the comparator CP1, and an output terminal of the comparator CP2 outputs a PWM signal PW2. A first input terminal of the AND gate AG1 is coupled to the output terminal of the comparator CP1, a second input terminal of the AND gate AG1 is coupled to the output terminal of the second comparator CP2, and an output terminal of the AND gate AG1 outputs a PWM signal PW' to the phase-splitting circuit 401. The phase-splitting circuit 401 receives the PWM signal PW' output by the AND gate AG1, and performs phase-splitting to the PWM signal PW' in response to a comparison signal CMS output by the automatic frequency tracing circuit 205 to obtain two output signals 01 and 02 with a phase difference of 180 degrees.

It should be noticed that if the driving apparatus 20 does not have the clamp circuit 211, the comparator CP2 and the AND gate AG1 of the power switching circuit 201 can be omitted. In this way, the phase-splitting circuit 401 directly receives the PWM signal PW1 output by the comparator CP1, and performs phase-splitting to the PWM signal PW1 in response to the comparison signal CMS output by the automatic frequency tracing circuit 205 to obtain two output signals 01 and 02 with a phase difference of 180 degrees. Moreover, in case that the automatic frequency tracing circuit 205 does not provide the comparison signal CMS to the phase-splitting circuit 401, the phase-splitting circuit 401 directly performs cross phase-splitting to the PWM signal PW1 to obtain two output signals 01 and 02 with a phase difference of 180 degrees.

The buffering circuit 403 is coupled to the phase-splitting circuit 401, and is composed of a buffer Buf1 and a buffer Buf2. The buffers Buf1 and Buf2 are used for respectively receiving and buffering-outputting the two output signals 01 and 02 (i.e. increasing driving capability of the output signals 01 and 02). The switching circuit 405 is coupled between the input voltage $V_{DD}$ and the ground potential GND, and is coupled to the buffering circuit 403. The switching circuit 405 is composed of two power switches Q1 and Q2, and is used for switching and outputting the input voltage $V_{DD}$ and the ground potential GND in response to the two buffered output signals 01 and 02, so as to generate the square signal SQ. First terminals of the power switches Q1 and Q2 are respectively coupled to the input voltage $V_{DD}$ and the ground potential GND, second terminals of the power switches Q1 and Q2 are coupled to each other to generate the square signal SQ, and control terminals of the power switches Q1 and Q2 respectively receive the two buffered output signals 01 and 02.

Referring to FIG. 3, the LC resonator 203 is coupled to the power switching circuit 203, and is used for receiving and converting the square signal SQ generated by the power switching circuit 201 to generate a sinusoidal driving signal SIN for driving the fluorescent lamp CL. In detail, the LC resonator 203 includes capacitors C1-C3 and an inductor L. A first end of the capacitor C1 is coupled to the second terminals of the power switches Q1 and Q2 to receive the square signal SQ. A first end of the inductor L is coupled to a second end of the capacitor C1, and a second end of the inductor L is used for generating the sinusoidal driving signal SIN. A first end of the capacitor C2 is coupled to the second end of the inductor L, and a second end of the capacitor C2 is used for generating a feedback signal FS related to the sinusoidal driving signal SIN. A first end of the capacitor C3 is coupled to the second end of the capacitor C2, and a second end of the capacitor C3 is coupled to the ground potential GND.

Moreover, in the present embodiment, the automatic frequency tracing circuit 205 is coupled to the power switching circuit 201 and the LC resonator 203, and is used for generating and adjusting the ramp signal RMP according to the feedback signal FS related to the sinusoidal driving signal SIN generated by the LC resonator 203, so as to make a frequency of the sinusoidal driving signal SIN generated by the LC resonator 203 automatically following a resonant frequency of the LC resonator 203. Obviously, a frequency of the ramp signal RMP generated by the automatic frequency tracing circuit 205 is not fixed, and is varied along with the variation of the sinusoidal driving signal SIN generated by the LC resonator 203.

In detail, the automatic frequency tracing circuit 205 includes a phase-shifting circuit 501, a pulse signal generator 503, a ramp generator 505, a starting of oscillation circuit 507 and a detection circuit 509. The phase-shifting circuit 501 is coupled to the second end of the capacitor C2, and is used for receiving the feedback signal FS and shifting a current phase of the feedback signal FS (for example, for 90 degrees, though the invention is not limited thereto) to output a phase-shifting signal PSS. In other words, a voltage phase of the phase-shifting signal PSS is 90 degrees ahead of a voltage phase of the feedback signal FS, which represents that the voltage phase of the phase-shifting signal PSS is the current phase of the feedback signal FS, i.e. the current phase of the capacitors C2 and C3 in the LC resonator 203.

In the present embodiment, the phase-shifting circuit 501 includes a resistor R1, an operational amplifier OP and a capacitor C4. A first end of the resistor R1 receives the feedback signal FS. A positive input terminal (+) of the operational amplifier OP is coupled to the ground potential GND, a negative input terminal (−) of the operational amplifier OP is coupled to a second end of the resistor R1, and an output terminal of the operational amplifier OP outputs the phase-shifting signal PSS. A first end of the capacitor C4 is coupled to the second end of the resistor R1, and a second end of the capacitor C4 is coupled to the output terminal of the operational amplifier OP.

Moreover, the pulse signal generator 503 is coupled to the phase-shifting circuit 501 and the phase-splitting circuit 401, and is used for generating a pulse signal PLS in response to the phase-shifting signal PSS output by the phase-shifting circuit 501, and providing the comparison signal CMS to the phase-splitting circuit 401. In detail, the pulse signal generator 503 includes a comparator CP3, a delay cell DLY and an XOR gate EG. A positive input terminal (+) of the comparator CP3 receives the phase-shifting signal PSS output by the phase-shifting circuit 501, a negative input terminal (−) of the comparator CP3 receives a predetermined reference voltage Vref1, and an output terminal of the comparator CP3 outputs the comparison signal CMS. The delay cell DLY is coupled to the output terminal of the comparator CP3, and is used for receiving and delaying-outputting the comparison signal CMS. A first input terminal of the XOR gate EG receives the comparison signal CMS, a second input terminal of the XOR gate EG receives a comparison signal CMS' output from the delay cell DLY, and an output terminal of the XOR gate EG generates the pulse signal PLS.

Moreover, the ramp generator 505 is coupled to the pulse signal generator 503 and the comparator CP1, and is used for generating the ramp signal RMP in response to the pulse signal PLS generated by the pulse signal generator 503. The starting of oscillation circuit 507 is coupled to the ramp generator 505, and is used for generating a starting of oscillation pulse signal ST_PLS to the ramp generator 505 in response to an enable signal EN generated by the detection circuit 509 when the ramp generator 505 does not obtain the pulse signal PLS generated by the pulse signal generator 503, so that the ramp generator 505 generates the ramp signal RMP until the ramp generator 505 obtains the pulse signal PLS generated by the pulse signal generator 503. In other words, once the ramp generator 505 obtains the pulse signal PLS generated by the pulse signal generator 503, the starting of oscillation circuit 507 stops generating the starting of oscillation pulse signal ST_PLS.

In the present embodiment, the starting of oscillation circuit 507 includes an AND gate AG2, a capacitor C5 and an inverter NT. A first input terminal of the AND gate AG2 receives the enable signal EN generated by the detection circuit 509. A first end of the capacitor C5 is coupled to an output terminal of the AND gate AG2, and a second end of the capacitor C5 is coupled to the ground potential GND. An input terminal of the inverter NT is coupled to the output terminal of the AND gate AG2, and an output terminal of the inverter NT is coupled to a second input terminal of the AND gate AG2 to output the starting of oscillation pulse signal ST_PLS.

Moreover, the detection circuit 509 is coupled to the starting of oscillation circuit 507, and is used for detecting the phase-shifting signal PSS output by the phase-shifting circuit 501 and generating the enable signal EN to the starting of oscillation circuit 507 when the phase-shifting signal PSS output by the phase-shifting circuit 501 is not oscillated, so as to enable the starting of oscillation circuit 507 to generate the starting of oscillation pulse signal ST_PLS. In other words, once the phase-shifting signal PSS output by the phase-shifting circuit 501 starts to oscillate, the detection circuit 509 does not generate the enable signal EN to the starting of oscillation circuit 507, so that the starting of oscillation circuit 507 stops generating the starting of oscillation pulse signal ST_PLS. Meanwhile, the ramp generator 505 generates the ramp signal RMP according to the pulse signal PLS generated by the pulse signal generator 503. In the present embodiment, the detection circuit 509 can independently exist in the automatic frequency tracing circuit 205, and can also be integrated with one of the phase-shifting circuit 501, the pulse signal generator 503 and the starting of oscillation circuit 507, which is determined according to an actual design requirement.

Moreover, in FIG. 3, the current regulation circuit 207 is coupled to the fluorescent lamp CL and the power switching circuit 201, and is used for generating the comparison voltage CMP in response to a current flowing through the fluorescent lamp and a predetermined reference voltage Vref2, so as to adjust the PWM signal PW1 output by the comparator CP1, and stabilize the current flowing through the fluorescent lamp CL to a predetermined current value. Obviously, the current regulation circuit 207 can be used for precise current feedback control.

In detail, the current regulation circuit 207 includes diodes D1 and D2, resistors R2 and R3, an error amplifier EA and a capacitor C6. A cathode of the diode D1 is coupled to one end of the fluorescent lamp CL, an anode of the diode D1 is coupled to the ground potential GND, and another end of the fluorescent lamp CL receives the sinusoidal driving signal SIN generated by the LC resonator 203. An anode of the diode D2 is coupled to the cathode of the diode D1. A first end of the resistor R2 is coupled to a cathode of the diode D2, and a second end of the resistor R2 is coupled to the ground potential GND. A first end of the resistor R3 is coupled to the cathode of the diode D2. A positive input terminal (+) of the error amplifier EA receives the predetermined reference voltage Vref2, a negative input terminal (−) of the error amplifier EA is coupled to a second end of the resistor R3, and an output terminal of the error amplifier EA outputs the comparison voltage CMP. A first end of the capacitor C6 is coupled to the second end of the resistor R3, and a second end of the capacitor C6 is coupled to the output terminal of the error amplifier EA.

Figure 5:
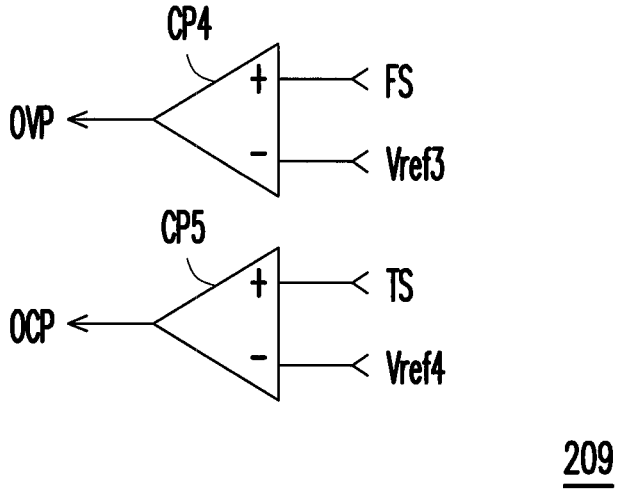
FIG. 5 is a schematic diagram of a protection circuit 209 according to an embodiment of the invention.

Moreover, in the present embodiment, the protection circuit 209 is coupled to the LC resonator 203 and the phase-splitting circuit 401, and is used for receiving the feedback voltage FS generated by the LC resonator 203 and generating an over voltage protection signal OVP to disable the phase-splitting circuit 401 (i.e. controlling the phase-splitting circuit 401 to stop generating the two output signals 01 and 02) when the feedback voltage FS is greater than a predetermined reference voltage (for example, Vref3 in FIG. 5). And, the protection circuit 209 is further coupled to the fluorescent lamp CL and the current regulation circuit 207, and is further used for determining whether or not to generate an over current protection signal OCP to disable the phase-splitting circuit 401 according to a transformation voltage TS related to the current flowing through the fluorescent lamp CL. When the transformation voltage TS is greater than a predetermined reference voltage (for example, Vref4 in FIG. 5), the protection circuit 209 generates the over current protection signal OCP to disable the phase-splitting circuit 401. Obviously, the protection circuit 209 enables a protection mechanism (which is generally implemented during an operation phase of the fluorescent lamp CL) when the fluorescent lamp CL is abnormally driven, so as to protect the fluorescent lamp CL.

In detail, FIG. 5 is a schematic diagram of the protection circuit 209 according to an embodiment of the invention. Referring to FIG. 2 to FIG. 5, the protection circuit 209 includes comparators CP4 and CP5. A positive input terminal (+) of the comparator CP4 receives the feedback voltage FS, a negative input terminal (−) of the comparator CP4 receives the predetermined reference voltage Vref3, and an output terminal of the comparator CP4 output the over voltage protection signal OVP. A positive input terminal (+) of the comparator CP5 receives the transformation voltage TS, a negative input terminal (−) of the comparator CP5 receives the predetermined reference voltage Vref4, and an output terminal of the comparator CP4 output the over current protection signal OCP.

Figure 6:
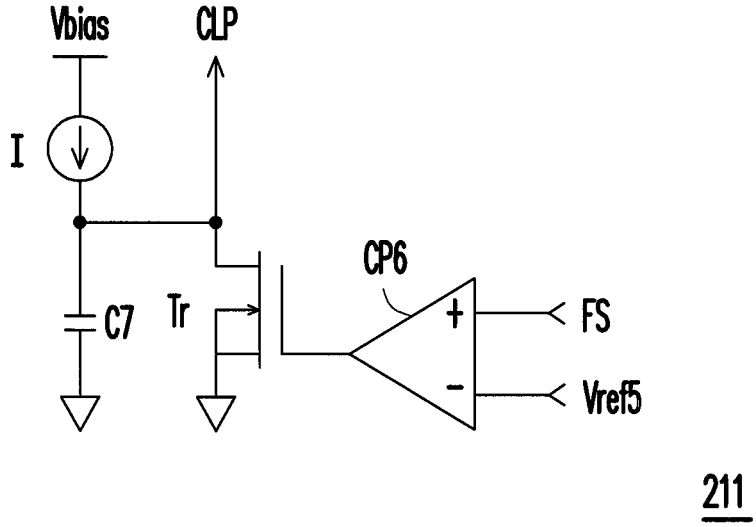
FIG. 6 is a schematic diagram of a clamp circuit 211 according to an embodiment of the invention.

Moreover, FIG. 6 is a schematic diagram of the clamp circuit 211 according to an embodiment of the invention. Referring to FIG. 2 to FIG. 6, the clamp circuit 211 is coupled to the LC resonator 203, and is used for generating the clamp voltage CLP in response to the feedback signal FS generated by the LC resonator 203 and a predetermined reference voltage Vref5, so as to suppress a voltage of the sinusoidal driving signal SIN generated by the LC resonator 203 to a predetermined voltage value. Obviously, the clamp circuit 211 can also prevent the sinusoidal driving signal SIN from an over voltage situation, which is generally implemented during an initial phase of the fluorescent lamp CL.

In detail, the clamp circuit 211 includes a comparator CP6, an N-type transistor Tr, a capacitor C7, and a current source I. A positive input terminal (+) of the comparator CP6 receives the feedback signal FS generated by the LC resonator 203, and a negative input terminal (−) of the comparator CP6 receives the predetermined reference voltage Vref5. A gate of the N-type transistor Tr is coupled to an output terminal of the comparator CP6, a drain of the N-type transistor Tr outputs the clamp voltage CLP, and a source of the N-type transistor Tr is coupled to the ground potential GND. A first end of the capacitor C7 is coupled to the drain of the N-type transistor Tr, and a second end of the capacitor C7 is coupled to the ground potential GND. The current source I is coupled between a bias voltage Vbias and the first end of the capacitor C7.

Figure 7A:
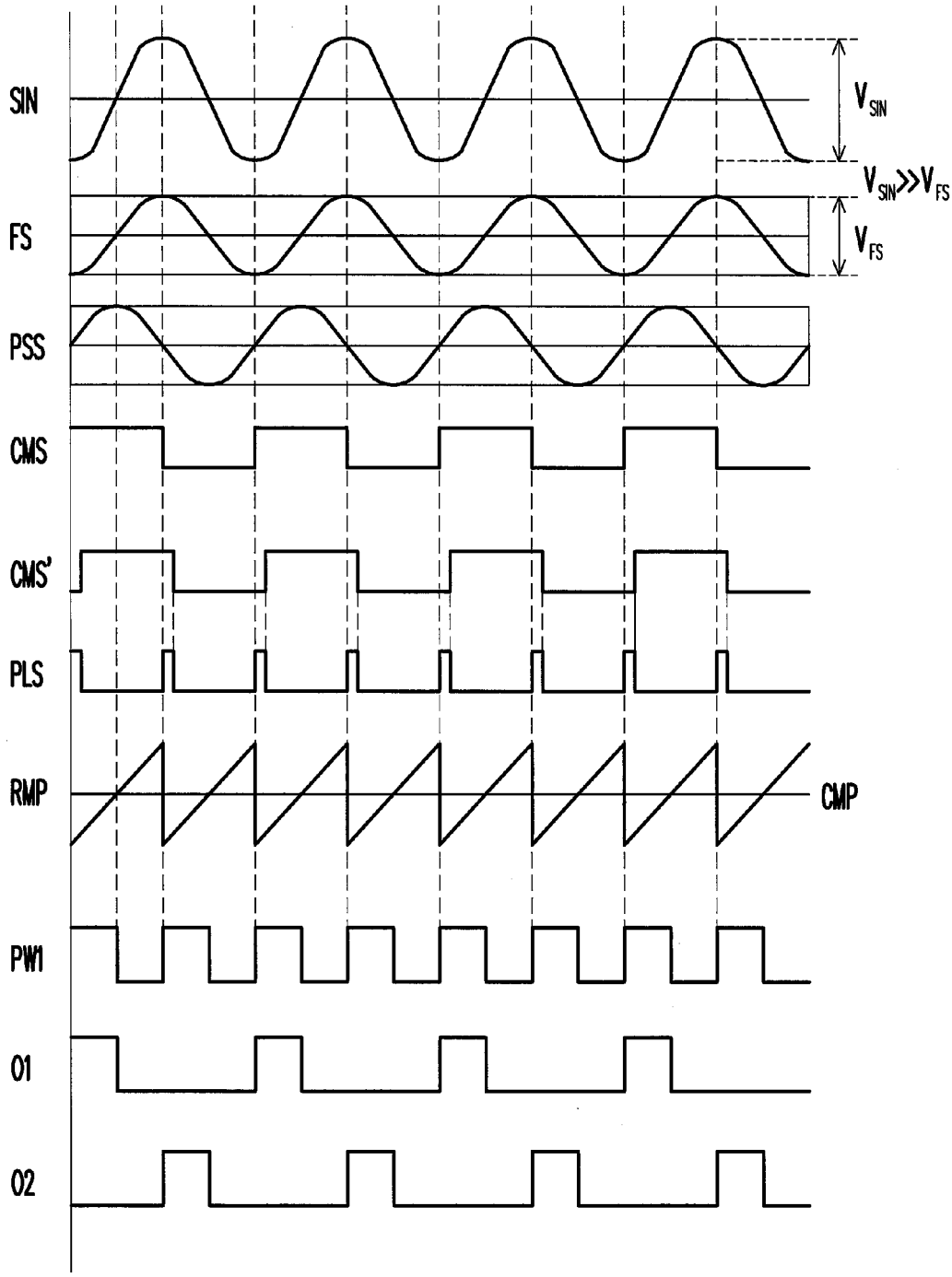
FIG. 7A is a waveform diagram of a part of signals of the driving apparatus 20 of the fluorescent lamp CL according to an embodiment of the invention.

From the above, FIG. 7A is a waveform diagram of a part of signals of the driving apparatus 20 of the fluorescent lamp CL according to an embodiment of the invention. According to FIG. 7A (also referring to FIG. 4), in case that the feedback signal FS is oscillated, the current phase of the phase-shifting signal PSS is 90 degrees ahead of the current phase of the feedback signal FS. Therefore, the following descriptions are deduced:

1. The comparator CP3 outputs the comparison signal CMS in response to the phase-shifting signal PSS and the predetermined reference voltage Vref1;
2. The XOR gate EG outputs the pulse signal PLS in response to the comparison signals CMS and CMS';
3. The comparator CP1 outputs the PWM signal PW1 in response to the ramp signal RMP and the comparison voltage CMP;
4. The phase-splitting circuit 401 performs the phase-splitting to the PWM signal PW1 in response to the respective rising and falling edges of the comparison signal CMS (in case that the PWM signal PW2 is not considered), so as to obtain the two output signals 01 and 02 with a phase difference of 180 degrees; and
5. When the sinusoidal driving signal SIN is in a relatively low area, the comparator CP3 generates the comparison signal CMS, and when the comparison signal CMS is in a relatively high area, the phase-splitting circuit 401 generates the output signal 01, in an actual application, a phase error exists between the comparison signal CMS and the output signal 01, and a magnitude of the phase error is determined by a quality factor (Q value) of the LC resonator 203.

According to the above descriptions 1-5, in case that the feedback signal FS is oscillated, the automatic frequency tracing circuit 205 makes the frequency of the sinusoidal driving signal SIN that is generated by the LC resonator 203 and used for driving the fluorescent lamp CL to automatically follow the resonant frequency of the LC resonator 203. In this way, as long as the quality factor (Q value) of the LC resonator 203 is designed relatively higher, a relatively large output to input ratio is obtained, and the driving apparatus 20 can successfully drive the fluorescent lamp CL without using a boost transformer.

Figure 7B:
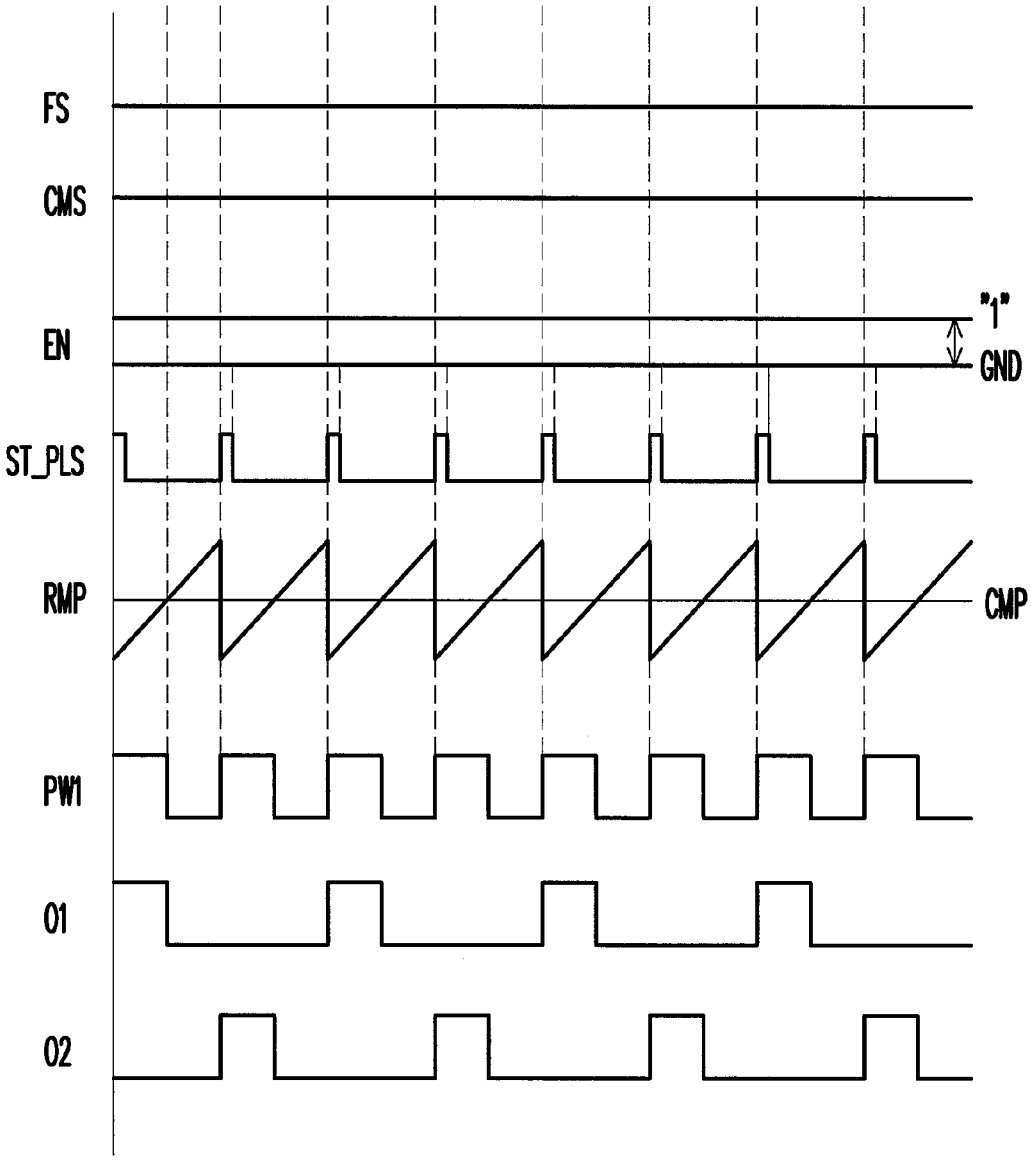
FIG. 7B is a waveform diagram of a part of signals of the driving apparatus 20 of the fluorescent lamp CL according to another embodiment of the invention.

FIG. 7B is a waveform diagram of a part of signals of the driving apparatus 20 of the fluorescent lamp CL according to another embodiment of the invention. According to FIG. 7B, in case that the feedback signal FS is not oscillated, since the phase-shifting circuit 501 does not generate the phase-shifting signal PSS, following descriptions are deduced:

6. The comparator CP3 cannot output the comparison signal CMS;
7. The detection circuit 509 generates the enable signal EN (i.e. logic "1") to the starting of oscillation circuit 507 in response to the non-oscillated phase-shifting signal PSS, and the starting of oscillation circuit 507 generates the starting of oscillation pulse signal ST_PLS to the ramp generator 505, and then the ramp generator 505 generates the ramp signal RMP;
8. The comparator CP1 outputs the PWM signal PW1 in response to the ramp signal RMP and the comparison voltage CMP; and
9. The phase-splitting circuit 401 directly performs cross phase-splitting to the PWM signal PW1 in response to the rising edge of the PWM signal PW1 (in case that the PWM signal PW2 is not considered) to obtain the two output signals 01 and 02 with a phase difference of 180 degrees.

According to the above descriptions 6-9, in case that the feedback signal FS is not oscillated, the automatic frequency tracing circuit 205 still makes the frequency of the sinusoidal driving signal SIN that is generated by the LC resonator 203 and used for driving the fluorescent lamp CL to automatically follow the resonant frequency of the LC resonator 203. Therefore, the driving apparatus 20 can still successfully drive the fluorescent lamp CL without using a boost transformer.

Figure 7C:
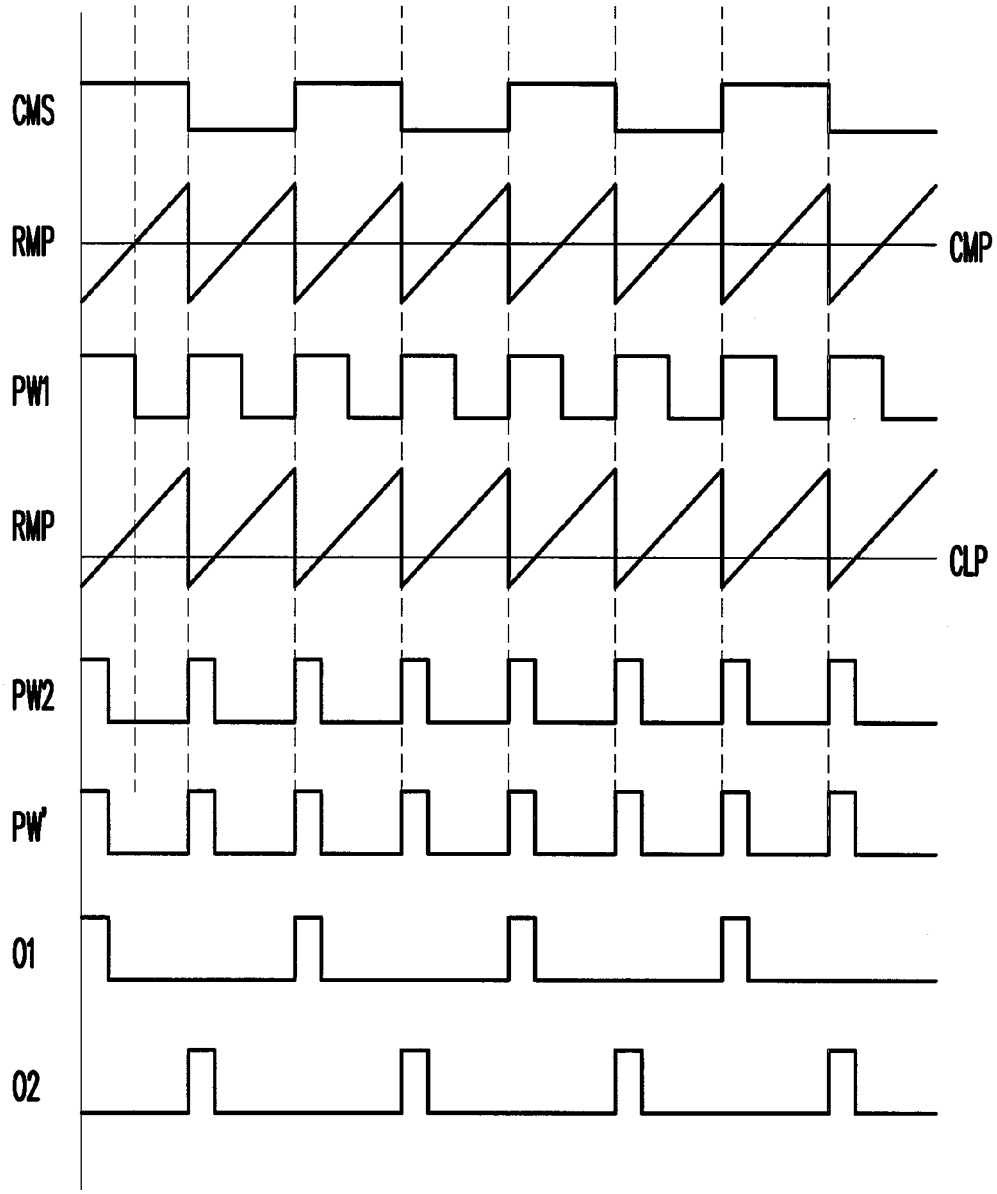
FIG. 7C is a waveform diagram of a part of signals of the driving apparatus 20 of the fluorescent lamp CL according to still another embodiment of the invention.

FIG. 7C is a waveform diagram of a part of signals of the driving apparatus 20 of the fluorescent lamp CL according to still another embodiment of the invention. According to FIG. 7C, in case that the voltage of the sinusoidal driving signal SIN is excessively high, for example, in the initial phase of the fluorescent lamp CL, following descriptions are deduced:

10. The comparator CP1 outputs the PWM signal PW1 with a relatively wide duty cycle in response to the ramp signal RMP and the comparison voltage CMP;
11. The comparator CP6 turns on the N-type transistor Tr in response to the feedback signal FS and the predetermined reference voltage Vref5 to generate the clamp voltage CLP, and the comparator CP2 generates the PWM signal PW2 with a relatively narrow duty cycle in response to the clamp voltage CLP and the ramp signal RMP;
12. The AND gate AG1 outputs the PWM signal PW' in response to the PWM signals PW1 and PW2; and
13. The phase-splitting circuit 401 performs the phase-splitting to the PWM signal PW' in response to the respective rising and falling edges of the comparison signal CMS, so as to obtain the two output signals 01 and 02 with less energies and a phase difference of 180 degrees (it is obvious compared to that of FIG. 7A and FIG. 7B).

According to the above descriptions 10-13, the clamp circuit 211 can suppress the voltage of the sinusoidal driving signal SIN to a predetermined voltage value during the initial phase of the fluorescent lamp CL, so as to protect the fluorescent lamp CL. Moreover, after the fluorescent lamp CL enters the operation phase from the initial phase, the clamp circuit 211 stops generating the clamp voltage CLP. In this way, during the operation phase of the fluorescent lamp CL, the protection circuit 209 takes over to protect the fluorescent lamp CL.

Figure 8:
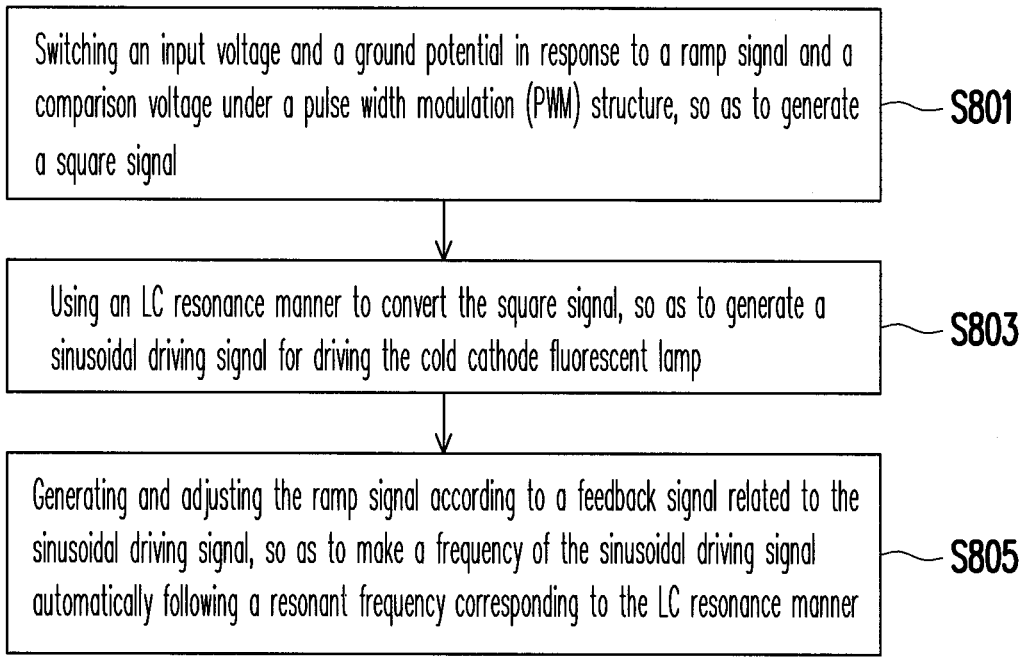
FIG. 8 is a flowchart illustrating a method for driving a fluorescent lamp according to an embodiment of the invention.

According to the above descriptions, a method for driving a fluorescent lamp is provided as that shown in FIG. 8, which includes following steps. Under a PWM structure, an input voltage and a ground potential are switched in response to a ramp signal and a comparison voltage, so as to generate a square signal (step S801). An LC resonance manner is used to convert the square signal to generate a sinusoidal driving signal for driving the fluorescent lamp (step S803). The ramp signal is generated and adjusted according to a feedback signal related to the sinusoidal driving signal, so as to make a frequency of the sinusoidal driving signal automatically following a resonant frequency corresponding to the LC resonance manner (step S805).

In summary, in the invention, the automatic frequency tracing circuit 205 is used to trace the resonant frequency of the LC resonator 203, so that regardless of how the resonant frequency of the LC resonator 203 varies, the automatic frequency tracing circuit 205 makes the frequency of the sinusoidal driving signal that is generated by the LC resonator 203 and used for driving the fluorescent lamp CL to automatically follow the resonant frequency of the LC resonator 203. In this way, as long as the quality factor (Q value) of the LC resonator is designed relatively higher, a relatively large output to input ratio is obtained, so that the fluorescent lamp CL can be successfully driven without using a boost transformer.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. An apparatus for driving a fluorescent lamp, comprising:

a power switching circuit, coupled between an input voltage and a ground potential, for switching and outputting the input voltage and the ground potential in response to a ramp signal and a comparison voltage, so as to generate a square signal;

an LC resonator, coupled to the power switching circuit, for receiving and converting the square signal, so as to generate a sinusoidal driving signal for driving the fluorescent lamp; and an automatic frequency tracing circuit, coupled to the power switching circuit and the LC resonator, for generating and adjusting the ramp signal according to a feedback signal related to the sinusoidal driving signal, so as to make a frequency of the sinusoidal driving signal automatically following a resonant frequency of the LC resonator.

2. The apparatus for driving the fluorescent lamp as claimed in claim 1, wherein the power switching circuit comprises:

a first comparator, having a negative input terminal receiving the ramp signal, a positive input terminal receiving the comparison voltage, and an output terminal outputting a first pulse width modulation signal;

a phase-splitting circuit, coupled to the first comparator, for receiving the first pulse width modulation signal, and performing phase-splitting to the first pulse width modulation signal in response to a comparison signal, or directly performing the phase-splitting to the first pulse width modulation signal, so as to obtain two output signals with a phase difference of 180 degrees;

a buffering circuit, coupled to the phase-splitting circuit, for receiving and buffering-outputting the two output signals; and a switching circuit, coupled between the input voltage and the ground potential and coupled to the buffering circuit, for switching and outputting the input voltage and the ground potential in response to the two buffered output signals, so as to generate the square signal.

3. The apparatus for driving the fluorescent lamp as claimed in claim 2, wherein the buffering circuit comprises:

two buffers, for respectively receiving and buffering-outputting the two output signals.

4. The apparatus for driving the fluorescent lamp as claimed in claim 2, wherein the switching circuit comprises:

two power switches, having first terminals respectively coupled to the input voltage and the ground potential, second terminals coupled to each other to generate the square signal, and control terminals respectively receiving the two buffered output signals.

5. The apparatus for driving the fluorescent lamp as claimed in claim 4, wherein the LC resonator comprises:

a first capacitor, having a first end coupled to the second terminals of the two power switches for receiving the square signal;

an inductor, having a first end coupled to a second end of the first capacitor, and a second end generating the sinusoidal driving signal;

a second capacitor, having a first end coupled to the second end of the inductor, and a second end generating the feedback signal; and a third capacitor, having a first end coupled to the second end of the second capacitor, and a second end coupled to the ground potential.

6. The apparatus for driving the fluorescent lamp as claimed in claim 5, wherein the automatic frequency tracing circuit comprises:

a phase-shifting circuit, coupled to the second end of the second capacitor, for receiving the feedback signal, and shifting a current phase of the feedback signal to output a phase-shifting signal;

a pulse signal generator, coupled to the phase-shifting circuit and the phase-splitting circuit, for generating a pulse signal in response to the phase-shifting signal, and providing the comparison signal; and a ramp generator, coupled to the pulse signal generator and the first comparator, for generating the ramp signal in response to the pulse signal.

7. The apparatus for driving the fluorescent lamp as claimed in claim 6, wherein the phase-shifting circuit comprises:

a resistor, having a first end receiving the feedback signal;

an operational amplifier, having a positive input terminal coupled to the ground potential, a negative input terminal coupled to a second end of the resistor, and an output terminal outputting the phase-shifting signal; and a fourth capacitor, having a first end coupled to the second end of the resistor, and a second end coupled to the output terminal of the operational amplifier.

8. The apparatus for driving the fluorescent lamp as claimed in claim 6, wherein the pulse signal generator comprises:

a second comparator, having a positive input terminal receiving the phase-shifting signal, a negative input terminal receiving a predetermined reference voltage, and an output terminal outputting the comparison signal;

a delay cell, coupled to the output terminal of the second comparator, for receiving and delaying-outputting the comparison signal; and an XOR gate, having a first input terminal receiving the comparison signal, a second input terminal receiving an output of the delay cell, and an output terminal generating the pulse signal.

9. The apparatus for driving the fluorescent lamp as claimed in claim 6, wherein the automatic frequency tracing circuit further comprises:

a starting of oscillation circuit, coupled to the ramp generator, for generating a starting of oscillation pulse signal to the ramp generator in response to an enable signal when the ramp generator does not obtain the pulse signal, so as to make the ramp generator generating the ramp signal until the ramp generator obtains the pulse signal; and a detection circuit, coupled to the starting of oscillation circuit, for detecting the phase-shifting signal, and generating the enable signal to the starting of oscillation circuit when the phase-shifting signal is not oscillated.

10. The apparatus for driving the fluorescent lamp as claimed in claim 9, wherein the starting of oscillation circuit comprises:

an AND gate, having a first input terminal receiving the enable signal;

a fourth capacitor, having a first end coupled to an output terminal of the AND gate, and a second end coupled to the ground potential; and an inverter, having an input terminal coupled to the output terminal of the AND gate, and an output terminal coupled to a second input terminal of the AND gate to output the starting of oscillation pulse signal.

11. The apparatus for driving the fluorescent lamp as claimed in claim 2, further comprising:

a current regulation circuit, coupled to the fluorescent lamp and the power switching circuit, for generating the comparison voltage in response to a current flowing through the fluorescent lamp and a predetermined reference voltage, so as to adjust the first pulse width modulation signal output by the first comparator, and stabilize the current flowing through the fluorescent lamp to a predetermined current value, wherein the current regulation circuit comprises:

a first diode, having a cathode coupled to one end of the fluorescent lamp, and an anode coupled to the ground potential, wherein another end of the fluorescent lamp receives the sinusoidal driving signal;

a second diode, having an anode coupled to the cathode of the first diode;

a first resistor, having a first end coupled to a cathode of the second diode, and a second end coupled to the ground potential;

a second resistor, having a first end coupled to the cathode of the second diode;

an error amplifier, having a positive input terminal receiving the predetermined reference voltage, a negative input terminal coupled to a second end of the second resistor, and an output terminal outputting the comparison voltage; and a capacitor, having a first end coupled to the second end of the second resistor, and a second end coupled to the output terminal of the error amplifier.

12. The apparatus for driving the fluorescent lamp as claimed in claim 11, further comprising:

a protection circuit, coupled to the LC resonator and the phase-splitting circuit, for receiving the feedback voltage and generating an over voltage protection signal to disable the phase-splitting circuit when the feedback voltage is greater than a first predetermined reference voltage, wherein the protection circuit is further coupled to the fluorescent lamp and the current regulation circuit, and is further used for determining whether or not to generate an over current protection signal to disable the phase-splitting circuit according to a transformation voltage related to the current flowing through the fluorescent lamp, wherein when the transformation voltage is greater than a second predetermined reference voltage, the protection circuit generates the over current protection signal to disable the phase-splitting circuit, wherein the protection circuit comprises:

a second comparator, having a positive input terminal receiving the feedback voltage, a negative input terminal receiving the first predetermined reference voltage, and an output terminal outputting the over voltage protection signal; and a third comparator, having a positive input terminal receiving the transformation voltage, a negative input terminal receiving the second predetermined reference voltage, and an output terminal outputting the over current protection signal.

13. The apparatus for driving the fluorescent lamp as claimed in claim 2, further comprising:

a clamp circuit, coupled to the LC resonator, for generating a clamp voltage in response to the feedback signal and a predetermined reference voltage, so as to suppress a voltage of the sinusoidal driving signal to a predetermined voltage value, wherein the clamp circuit comprises:

a second comparator, having a positive input terminal receiving the feedback signal, and a negative input terminal receiving the predetermined reference voltage;

an N-type transistor, having a gate coupled to an output terminal of the second comparator, a drain outputting the clamp voltage, and a source coupled to the ground potential;

a capacitor, having a first end coupled to the drain of the N-type transistor, and a second end coupled to the ground potential; and a current source, coupled between a bias voltage and the first end of the capacitor.

14. The apparatus for driving the fluorescent lamp as claimed in claim 13, wherein the power switching circuit further comprises:

a third comparator, having a positive input terminal receiving the clamp voltage, a negative input terminal coupled to the negative input terminal of the first comparator, and an output terminal outputting a second pulse width modulation signal; and an AND gate, having a first input terminal coupled to the output terminal of the first comparator, a second input terminal coupled to the output terminal of the third comparator, and an output terminal outputting a third pulse width modulation signal to the phase-splitting circuit.

15. A method for driving a fluorescent lamp, comprising:

switching an input voltage and a ground potential in response to a ramp signal and a comparison voltage under a pulse width modulation structure, so as to generate a square signal;

using an LC resonance manner to convert the square signal, so as to generate a sinusoidal driving signal for driving the fluorescent lamp; and generating and adjusting the ramp signal according to a feedback signal related to the sinusoidal driving signal, so as to make a frequency of the sinusoidal driving signal automatically following a resonant frequency corresponding to the LC resonance manner.

* * * * *